US007099614B2

(12) United States Patent
Koizumi

(10) Patent No.: US 7,099,614 B2
(45) Date of Patent: Aug. 29, 2006

(54) COLOR IMAGE FORMING APPARATUS AND METHOD OF CONTROLLING SAME

(75) Inventor: Kazuhisa Koizumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/251,772

(22) Filed: Oct. 18, 2005

(65) Prior Publication Data

US 2006/0088345 A1 Apr. 27, 2006

(30) Foreign Application Priority Data

Oct. 25, 2004 (JP) ..... 2004-309871

(51) Int. Cl.
*G03G 15/01* (2006.01)

(52) U.S. Cl. ..... 399/301; 399/302; 399/303; 399/9; 399/15; 399/72; 399/308

(58) Field of Classification Search ..... 399/313, 399/308, 301, 9, 15, 40, 49, 72, 298, 302, 399/303, 66, 167
See application file for complete search history.

(56) References Cited

U.S. PATENT DOCUMENTS

| | | | | |
|---|---|---|---|---|
| 4,601,568 | A * | 7/1986 | Takano et al. | 399/200 |
| 4,723,145 | A * | 2/1988 | Takada et al. | 399/36 |
| 4,961,089 | A * | 10/1990 | Jamzadeh | 399/165 |
| 5,287,162 | A * | 2/1994 | de Jong et al. | 399/49 |
| 5,394,223 | A * | 2/1995 | Hart et al. | 399/165 |
| 5,412,302 | A | 5/1995 | Kido et al. | |
| 5,448,266 | A * | 9/1995 | Jamzadeh | 347/225 |
| 5,881,346 | A * | 3/1999 | Mori et al. | 399/301 |
| 6,038,423 | A | 3/2000 | Tagawa et al. | 399/301 |
| 6,941,096 | B1 * | 9/2005 | Matsuda et al. | 399/167 |
| 2001/0000968 | A1 * | 5/2001 | Hata | 347/116 |
| 2002/0003973 | A1 * | 1/2002 | Saito | 399/167 |
| 2004/0086299 | A1 * | 5/2004 | Matsuda et al. | 399/167 |
| 2005/0249524 | A1 * | 11/2005 | Matsuda et al. | 399/167 |

FOREIGN PATENT DOCUMENTS

| | | |
|---|---|---|
| JP | 2-262166 | 10/1990 |
| JP | 04-172376 | 6/1992 |
| JP | 06-130871 | 5/1994 |
| JP | 06-175427 | 6/1994 |
| JP | 10-186787 | 7/1998 |
| JP | 2000-316292 | 11/2000 |

OTHER PUBLICATIONS

English Translation of JP 2-262166.
English Translation of JP 2000-316292.

* cited by examiner

*Primary Examiner*—David M. Gray
*Assistant Examiner*—Geoffrey T. Evans
(74) *Attorney, Agent, or Firm*—Fitzpatrick, Cella, Harper & Scinto

(57) ABSTRACT

An image having a quality superior to that of the prior art is obtained even if there are multiple causes of image degradation. In a color image forming apparatus that includes a plurality of rotating bodies for forming a color image by rotating in cooperation, amounts of fluctuation in the rotational speeds of the rotating bodies that cause a decline in the image quality of the color image are detected for every rotating body (i.e., for every cause) and the detected amounts of fluctuation are corrected appropriately.

8 Claims, 8 Drawing Sheets

COLOR IMAGE FORMING APPARATUS AND METHOD OF CONTROLLING SAME

FIELD OF THE INVENTION

This invention relates to a color image forming apparatus for forming a color image.

BACKGROUND OF THE INVENTION

In general, an electrophotographic image formation apparatus forms a toner image on a transfer belt and transfers the formed toner image to a printing material, thereby forming a permanent image on the printing material. Further, a color image forming apparatus uses a plurality of color toners of different colors one after another to superimpose and form a plurality of toner images. This means that if the rotational speed of the transfer belt when the toner image of a certain color is formed and the rotational speed of the transfer belt when the next toner image is formed do not coincide, the respective images will deviate from each other. This is referred to as so-called "color misalignment".

Conceivable causes of color misalignment are as follows:

(1) a fluctuation in speed caused by uneven thickness of an intermediate transfer belt;

(2) a fluctuation in speed due to eccentricity of the driving roller that drives the transfer belt; and (3) a fluctuation in the angular speed of the driving roller.

An example of a method of eliminating cause (1) is disclosed in the specification of Japanese Patent Application Laid-Open No. 10-186787 (Patent Reference 1). This specification proposes a method of forming a registration pattern (a toner image) on a transfer belt, extracting a fluctuation in the traveling speed of the transfer belt based upon pass-by timing of the registration pattern and controlling a driving roller in accordance with extracted fluctuation in traveling speed.

On the other hand, the specification of Japanese Patent Application Laid-Open No. 6-130871 (Patent Reference 2) proposes a method of providing a transfer belt with an optical or magnetic pattern instead of a registration pattern at the time of manufacture, and sensing this pattern by a sensor to thereby detect a fluctuation in the traveling speed of the transfer belt.

With regard to cause (2), the specification of Japanese Patent Application Laid-Open No. 4-172376 (Patent Reference 3) proposes a method of detecting a fluctuation in the traveling speed of a transfer belt by an encoding roller that slides on the transfer belt, and making the distance between the image forming units equal to a whole-number multiple of the circumference of the encoding roller.

With regard to cause (4), the specification of Japanese Patent Application Laid-Open No. 6-175427 (Patent Reference 4) proposes a method of providing the shaft of a driving roller with an encoder and detecting a fluctuation in the angular speed of the driving roll.

In accordance with the prior art described above, only methods of dealing with conceivable specific causes are proposed and it is not possible to deal with color misalignment or inconsistencies in density ascribable to causes other than those conceived. With an image forming apparatus in which cause (1) is dominant, the invention of Patent Reference 1 or 2 is ideal. With an image forming apparatus in which cause (2) or (3) is dominant, however, color misalignment or inconsistencies in density cannot be reduced adequately. Similarly, with the method of Patent Reference 3 or 4 regarding cause (1), color misalignment or inconsistencies in density cannot be reduced adequately. In other words, there is a need for an image forming apparatus in which color misalignment and inconsistencies in density can be reduced even if multiple causes are present.

SUMMARY OF THE INVENTION

Accordingly, an object of the present invention is to solve the aforementioned problems and at least one other problem. The other problems will be understood from a reading of the entire specification.

In accordance with the present invention, there is provided a color image forming apparatus that includes a plurality of rotating bodies for forming a color image by rotating in cooperation, the apparatus detecting, with regard to first and second rotating bodies among the plurality of rotating bodies, amounts of fluctuation in rotational speeds of the rotating bodies that cause a decline in image quality of the color image formed, correcting the rotational speed of the first rotating body so as to cancel out the amount of fluctuation detected with regard to the first rotating body, and controlling the rotational speed of the second rotating body so as to cancel out the amount of fluctuation in rotational speed of the second rotating body detected after the rotational speed of the first rotating body has been corrected.

In accordance with the present invention, a color image forming apparatus that includes a plurality of rotating bodies for forming a color image by rotating in cooperation is adapted to detect, for every rotating body (i.e., for every cause), the amount of fluctuation in rotational speed of the rotating body that gives rise to a decline in the image quality of the color image, and correct each amount of deviation detected. As a result, it is possible to provide an image the quality of which is superior to that of the prior art even if there are multiple causes of image degradation.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
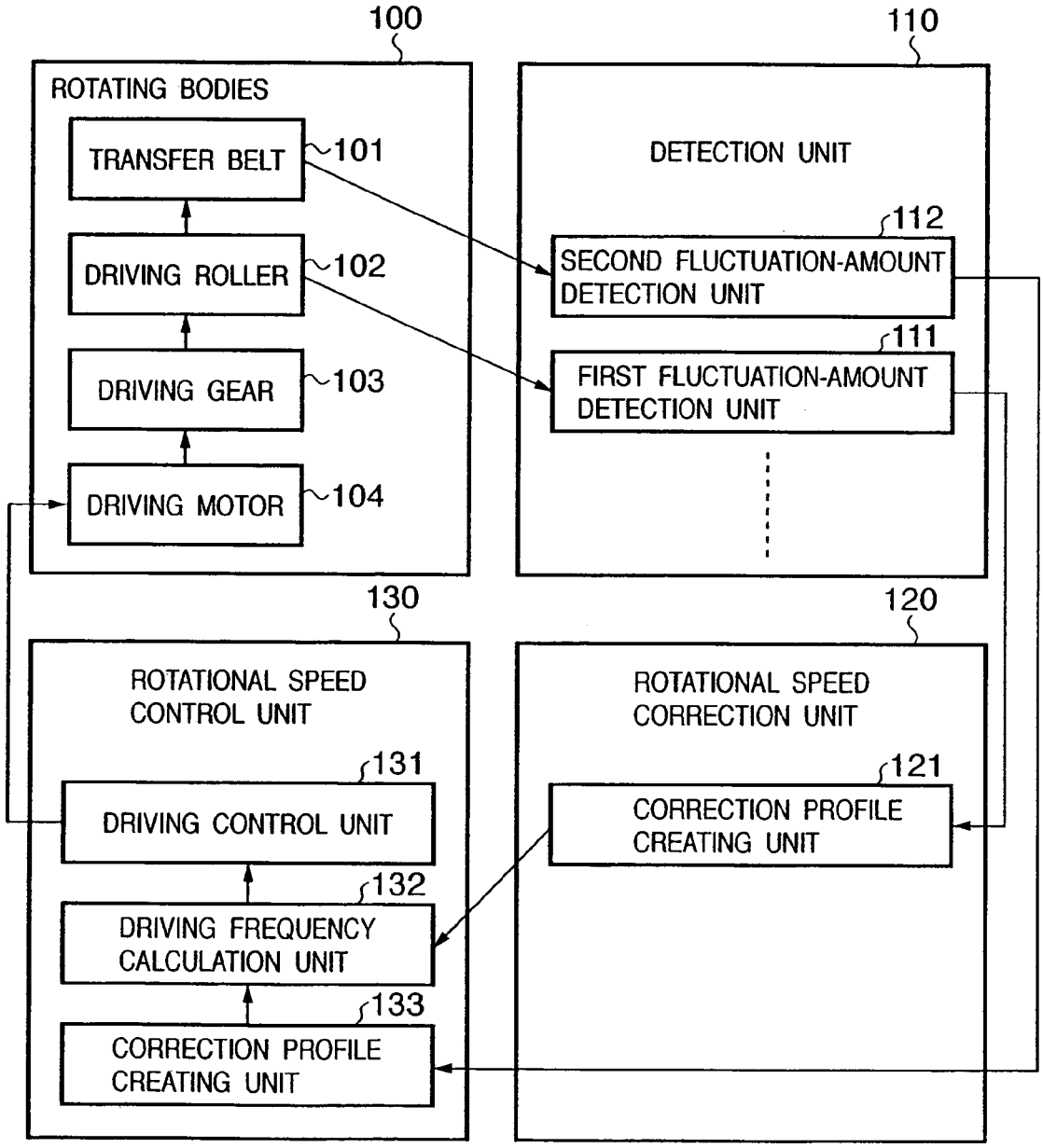
FIG. 1 is a block diagram exemplifying a color image forming apparatus according to an embodiment of the present invention.

FIG. 1 is a block diagram exemplifying a color image forming apparatus according to an embodiment of the present invention. The color image forming apparatus includes a plurality of image forming units for forming images by developing materials having colors that differ from one another. The image forming units form a color image by causing their images resulting from the developing materials to be superimposed on a transfer belt, and transfer the formed color image to a printing material.

In FIG. 1, a plurality of rotating bodies 100 constitute a unit that forms a color image owing to rotation of the rotating bodies in concert. The plurality of rotating bodies 100 may include a transfer belt 101 for transferring the images of the developing materials, which have been formed by these plurality of developing materials of different colors, to a printing material; a driving roller 102 for driving the transfer belt 101. The rotating bodies 100 may further include, for example, a driving gear 103 for driving the driving roller 102 and a driving motor 104 for driving the driving gear 103.

A detection unit 110 detects the amounts of fluctuation in rotational speeds of the rotating bodies, which deviation gives rise to a decline in the image quality of the color image formed, with regard to first and second rotating bodies among the plurality of rotating bodies. For example, the detection unit 110 may include a first fluctuation-amount detection unit 111 for detecting the amount of fluctuation of the driving roller 102 caused by eccentricity of the driving gear 103. The detection unit 110 may further include a second fluctuation-amount detection unit 112 for detecting the amount of fluctuation in belt traveling speed caused by an irregularity in the speed of the belt surface of the transfer belt 101.

A rotational speed correction unit 120 corrects the rotational speed of the first rotating body so as to cancel out the amount of fluctuation in the rotational speed detected with regard to the first rotating body. The rotational speed correction unit 120 may include a first correction profile creating unit 121 that creates a first correction profile, which is for correcting the rotational speed of the driving motor 104, from a plurality of amounts of fluctuation detected by the first fluctuation-amount detection unit 111 during the time the driving roller 102 makes one revolution, by way of example.

A rotational speed control unit 130 controls the rotational speed of the second rotating body so as to cancel out the amount of fluctuation in the rotational speed of the second rotating body (e.g., the transfer belt 101, etc.) detected after the rotational speed of the first rotating body (e.g., the driving roller 102) has been corrected based upon the first correction profile. The rotational speed control unit 130 may include a second creating unit 133 that creates a second correction profile, which corrects the rotational speed of the driving motor 104, from amount of fluctuation acquired by the second fluctuation-amount detection unit 112 during one revolution of the transfer belt 101 that is the result of driving the driving motor 104 by the first correction profile. The rotational speed control unit 130 may further include a calculation unit 132 for calculating driving frequency of the driving motor 104 from the second correction profile; and a driving control unit 131 for driving the driving motor 104 using the driving frequency calculated. It should be noted that the calculation unit 132 may be utilized also when the driving frequency of the driving motor 104 is calculated based upon the first correction profile.

Figure 2:
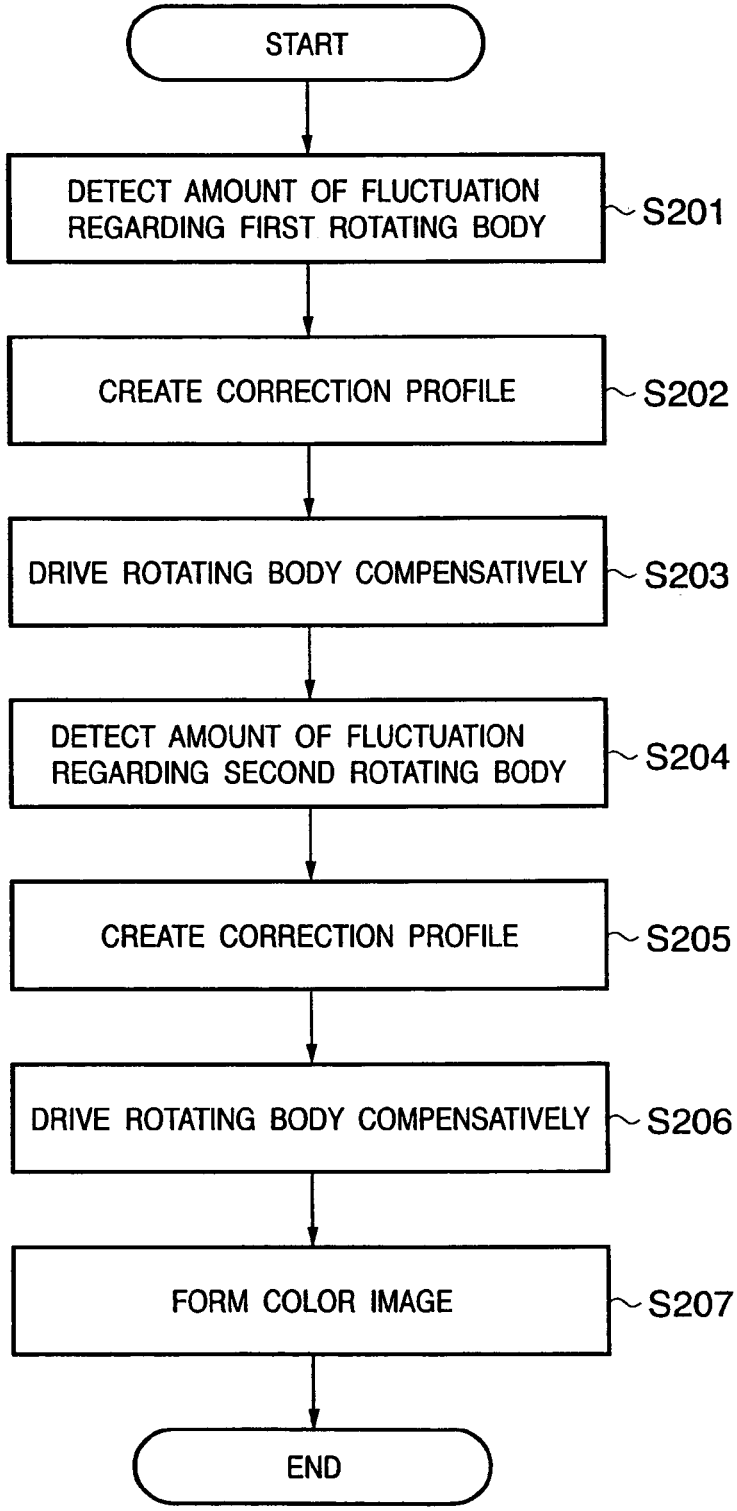
FIG. 2 is an illustrative flowchart for controlling the color image forming apparatus according to this embodiment.

FIG. 2 is an illustrative flowchart for controlling the color image forming apparatus according to this embodiment. Generally, the processing of this flowchart preferably is executed before the color image is formed on the printing material.

The plurality of rotating bodies 100 rotate in cooperation owing to start of rotation of the driving motor 104 at a default driving frequency. At step S201 the detection unit 110 detects the amount of fluctuation in the rotational speed of the first rotating body, this fluctuation being a cause of a decline in image quality of the color image to be formed.

Next, at step S202, the rotational speed correction unit 120 corrects the rotational speed of the first rotating body so as to cancel out the amount of fluctuation detected in regard to the first rotating body. More specifically, the first correction profile creating unit 121 creates the first correction profile for reducing the amount of fluctuation in the rotational speed of the driving roller 102.

Next, at step S203, the driving frequency calculation unit 132 calculates the driving frequency based upon the first correction profile, and then the driving control unit 131 controls the drive of the driving motor 104 based upon the driving frequency calculated. The power from the driving motor 104 is transmitted to the driving roller 102 via the driving gear 103. As a result, the first rotating body is driven upon being corrected. That is, a cause of a decline in image quality relating to the first rotating body diminished.

This is followed by step S204, at which the detection unit 110 detects the amount of fluctuation in the rotational speed of the second rotating body after the rotational speed of the first rotating body is corrected.

Next, at step S205, the rotational speed control unit 130 controls the rotational speed of the second rotating body so as to cancel out the amount of fluctuation in the rotational speed of the second rotating body. For example, the second correction profile creating unit 133 creates the second correction profile so as to cancel out the detected amount of fluctuation in the rotational speed of the second rotating body.

Next, at step S206, the rotational speed control unit 130 controls the rotational speed of the second rotating body based upon the second correction profile. For example, the driving frequency calculation unit 132 calculates the driving frequency in accordance with at least the second correction profile. Of course, the calculation unit 132 may calculate the driving frequency based upon both the first and second correction profiles. The driving control unit 131 drives the driving motor 104 by the driving frequency calculated. The power from the driving motor 104 is transmitted to the transfer belt 101 via the driving gear 103 and driving roller 102, as a result of which the transfer belt 101 is driven upon being corrected.

Thus, in accordance with this embodiment, as described above, amounts of fluctuation in the rotational speeds of rotating bodies that cause a decline in the quality of a color image are detected for every rotating body (i.e., for every cause), and each amount of fluctuation detected is corrected for in appropriate fashion. As a result, an image of quality superior to that of the prior art can be provided even if multiple causes of a decline in image quality are present.

For example, in comparison with an example of the prior art that takes only unevenness in the thickness of the transfer belt into account or an example of the prior art that considers only the eccentricity component of the driving roller, the present invention makes it possible to provide an image of far better quality.

Described next will be an example in which the present invention is applied to a color image forming apparatus having four image forming units that use toners of colors that different from one another. It goes without saying that the present invention is applicable also to a color image forming apparatus that uses developing materials of more than four colors.

Figure 3:
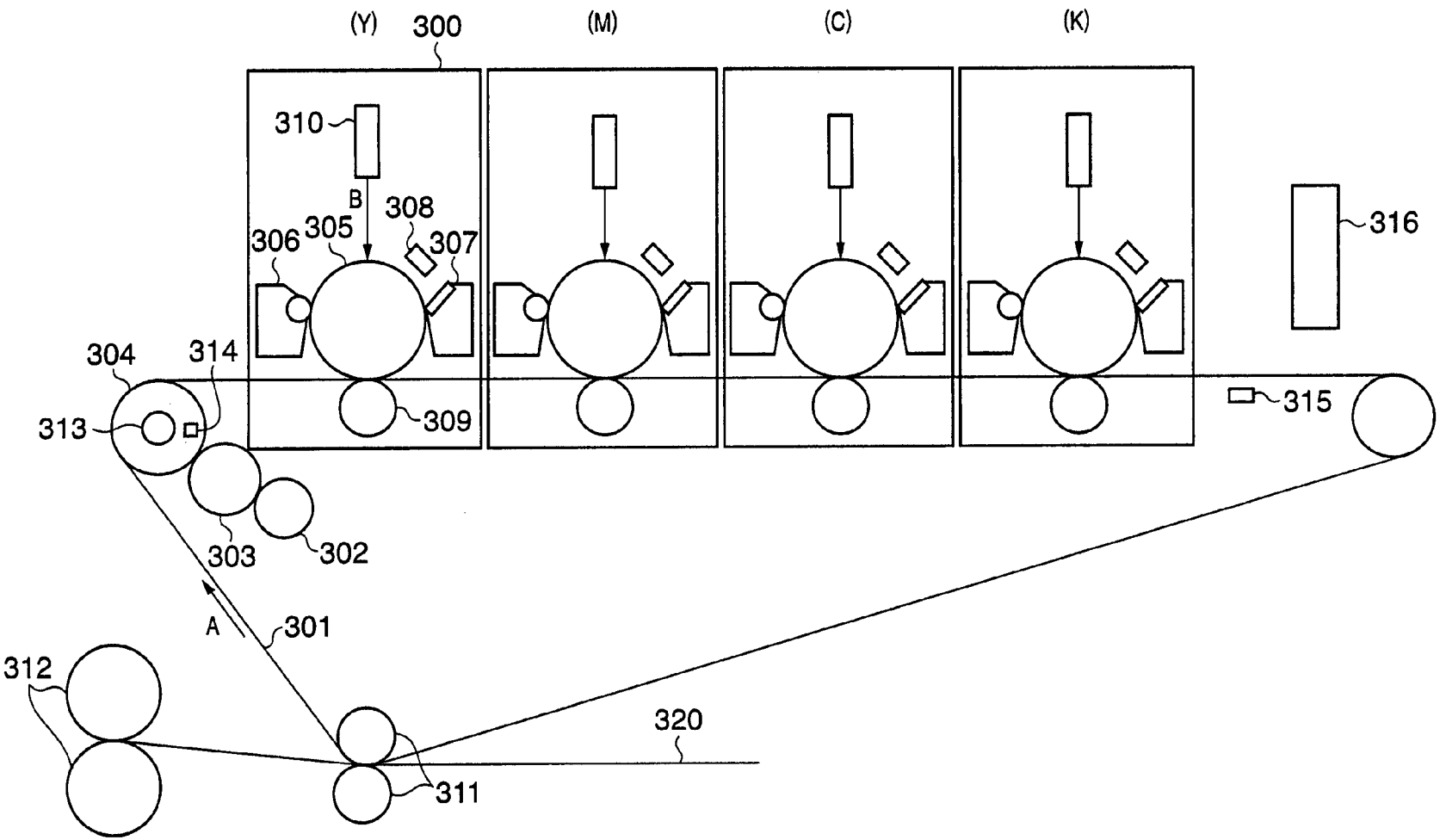
FIG. 3 is a diagram illustrating schematically the structure of an image forming apparatus according to this embodiment.

FIG. 3 is a diagram illustrating schematically the structure of an image forming apparatus according to this embodiment. The image forming engine of this image forming apparatus has four image forming units 300. Each image forming unit 300 includes a photosensitive body 305 such as a photosensitive drum on the surface of which a latent image is formed; a developing device 306 for developing the latent image, which has been formed on the photosensitive body 305, into a toner image; and a cleaner 307 for removing toner from the photosensitive body 305. Each image forming unit 300 further includes a charging device 308 for uniformly charging the photosensitive body 305 and a primary transfer roller 309 for primary transfer of the toner image, which has been formed on the surface of the photosensitive body 305, onto an intermediate transfer belt 301. Each image forming unit 300 further includes a laser optical system 310 for forming the latent image by irradiating the surface of the charged photosensitive body 305 with laser light.

The image forming units 300 form toner images of respective ones of different colors on the intermediate transfer belt 301. In this embodiment, a Y (yellow) toner image, M (magenta) toner image, C (cyan) toner image and K (black) toner image are formed on the intermediate transfer belt 301.

A driving motor 302 such as a stepping motor rotates a driving roller 304 via a gear 303. The driving roller 304 drives the intermediate transfer belt 301 by frictional sliding contact.

Basic image processing is as follows: The charging device 308 uniformly charges an optical semiconductor layer of the photosensitive body 305 (this step constitutes charging processing). The laser optical system 310 irradiates the photosensitive body 305 with an image pattern (an electrostatic latent image) (this step constitutes laser exposure processing). The developing device 306 forms a toner image by causing toner to adhere to the electrostatic latent image that has been formed on the photosensitive body 305 (this step constitutes developing processing). The primary transfer roller 309 transfers the toner image, which has been formed on the photosensitive body 305, to the intermediate transfer belt 301. These processing steps are executed by each of the image forming units that correspond to respective ones of the colors.

A secondary transfer device 311 transfers the toner image, which has been formed on the intermediate transfer belt 301, to printing paper 320 (this step constitutes secondary transfer processing). A fixing device 311 applies heat and pressure to the toner image that has been transferred to the printing paper 320, thereby fixing the toner to the printing paper 320 (this step constitutes fixing processing). Furthermore, the cleaner 307 cleans off toner remaining on the photosensitive body 305 because it could not be transferred completely to the intermediate transfer belt 301 (this step constitutes cleaning processing).

As mentioned above, the toner images that have been formed by each of the image forming units 300 are superimposed on the intermediate transfer belt 301. Consequently, if the speed of the intermediate transfer belt 301 fluctuates, the positions at which the images of the respective colors are formed will vary and this will lead to a decline in image quality such as color misalignment (a shift in the positions at which the primary transfer is performed) and an uneven in density.

Accordingly, in this embodiment, a plurality of fluctuation-amount detection units for detecting a plurality of amounts of fluctuation are provided in order to mitigate these factors. First, a rotary encoder 313 for detecting the rotational speed (angular speed) of the driving roller 304 is placed on the shaft of the driving roller 304.

A driving-roller home-position sensor 314 for sensing a reference position (home position) of the driving roller 304 also is placed on the shaft of the driving roller 304. More specifically, the driving-roller home-position sensor 314 functions as a phase detection unit for detecting the rotational phase of the driving roller 304. When the driving-roller home-position sensor 314 detects a reference position the first time and then detects the reference position again, this second detection means that the driving roller 304 has made one revolution. Of course, this applies to a case where only one reference position is provided.

Further, a belt home-position sensor 315 sensor senses an optical or magnetic home-position mark provided on the intermediate transfer belt 301. More specifically, the belt home-position sensor 315 functions as phase detection unit for detecting the rotational phase of the intermediate transfer belt 301. If there is only one mark, then, when the belt home-position sensor 315 detects the mark the first time and then detects the mark again, this second detection means that the transfer belt 101 has made one revolution.

An image reading sensor 316 is a detection unit for detecting a toner image or prescribed pattern that has been formed on the intermediate transfer belt 301.

Figure 4:
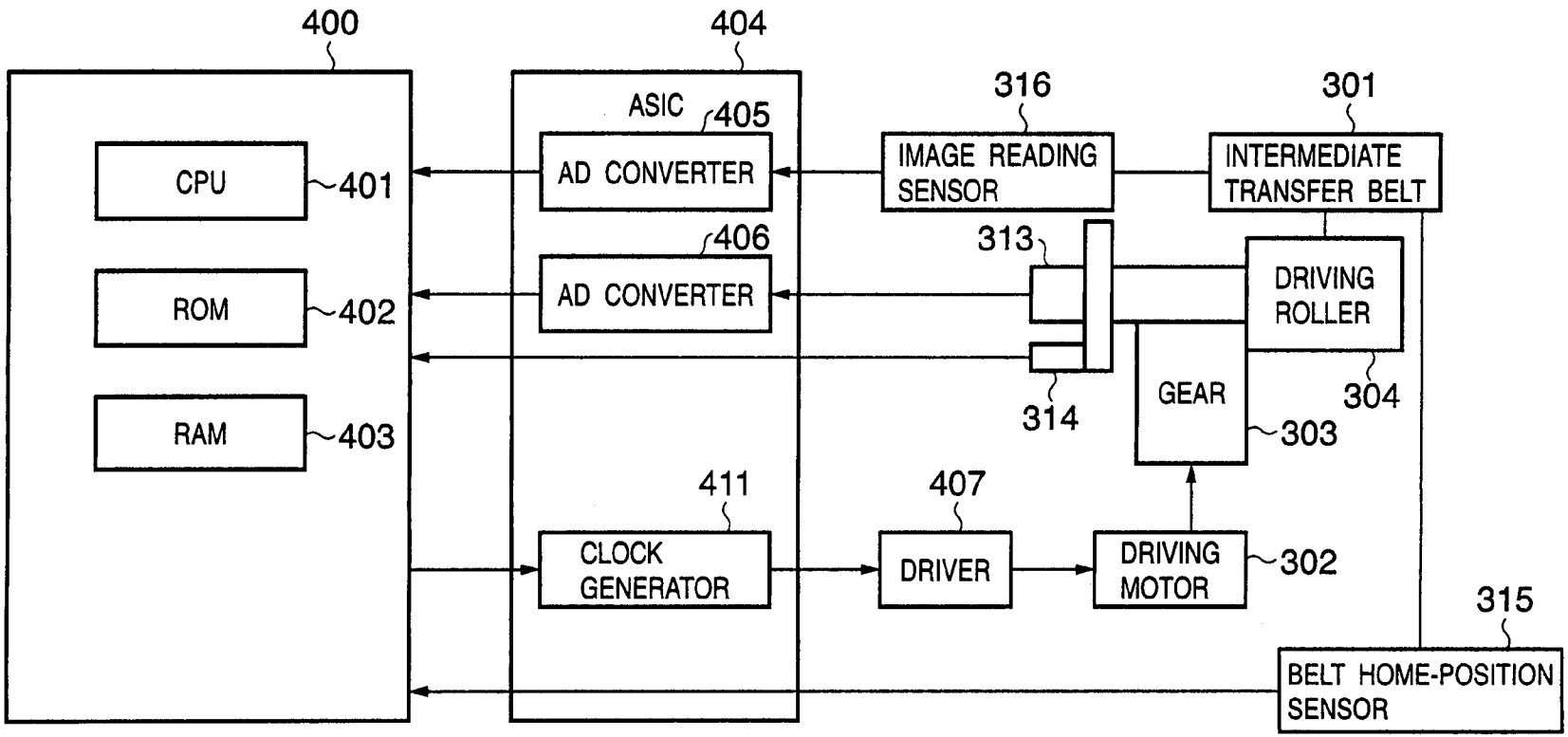
FIG. 4 is a block diagram relating to a control unit of the image forming apparatus according to this embodiment.

FIG. 4 is a block diagram relating to a control unit of the image forming apparatus according to this embodiment. The apparatus is under centralized control of a system controller 400. Further, the system controller 400 controls the driving of each load in the apparatus and collects and analyzes information from sensors.

The system controller 400 is equipped with a CPU 401, a ROM 402, a RAM 403 and an ASIC 404, etc. The CPU 401 executes various control sequences, such as a predetermined image formation sequence, in accordance with a control program that has been stored in the ROM 402. For example, the CPU 401 is capable of executing a sequence for generating a correction profile, which is described below, before the image formation sequence is executed. Further, the CPU 401 stores rewritable data, which requires to be saved temporarily or permanently, in the RAM 403.

The ASIC 404 has an AD converter 405 for applying an analog-to-digital conversion to the output signal from the image reading sensor 316, and an AD converter 406 for applying an analog-to-digital conversion to the output signal from the encoder 313. The digital data that has been output from each of these AD converters is transmitted to the system controller 400.

The ASIC 404 further has a clock generator 411 for driving the driving motor 302. The clock generator 411 outputs a driving clock to a motor driver 407 based upon a value that has been set by the CPU 401. The motor driver 407 drives the driving motor 302 based upon the frequency of the driving clock transmitted from the ASIC 404.

Figure 5:
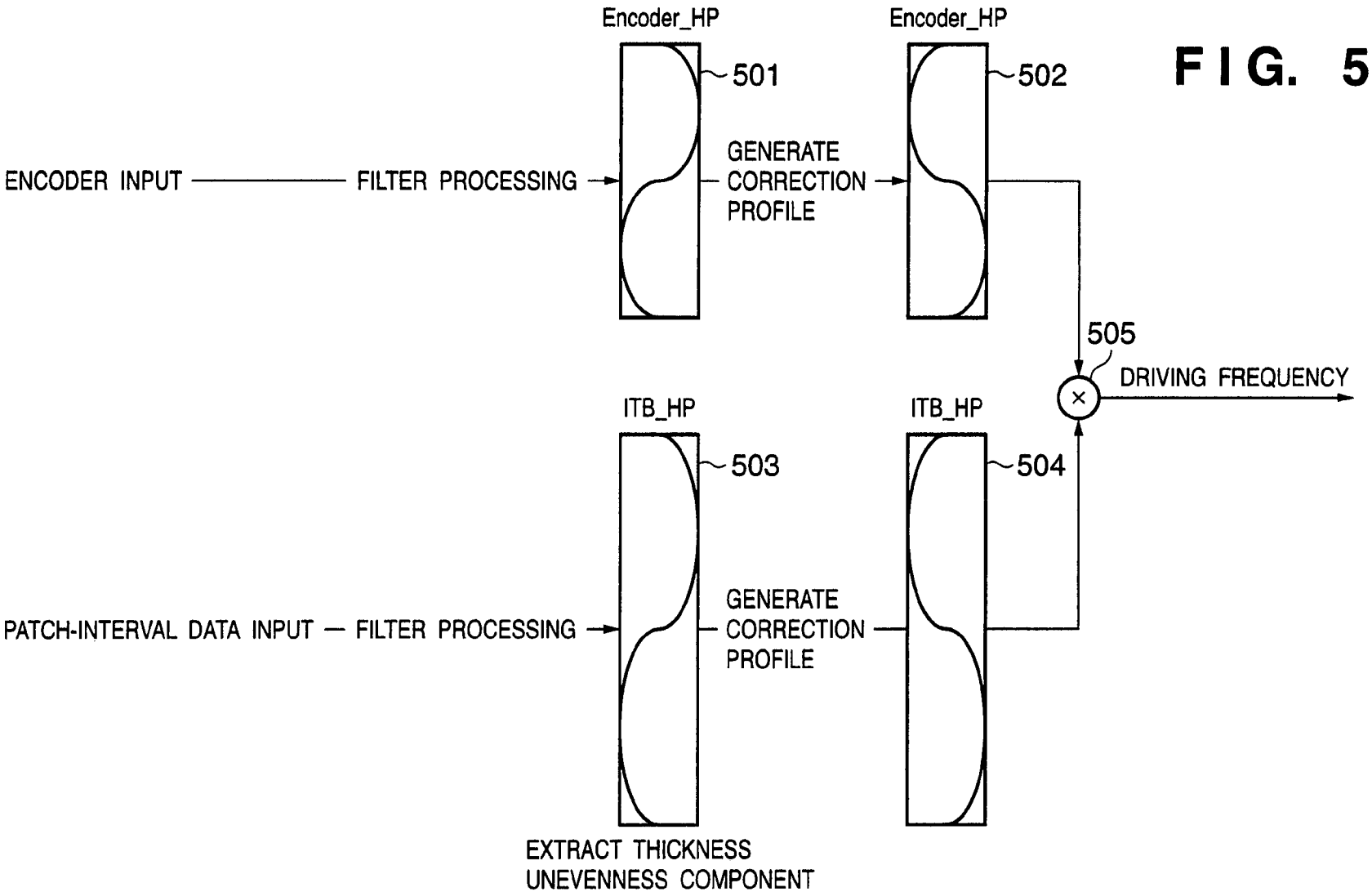
FIG. 5 is a conceptual view of control according to this embodiment.

FIG. 5 is a conceptual view of control according to this embodiment. The basic concept of the present invention involves separately detecting multiple causes of color misalignment or color unevenness and suppressing these causes. Since the driving roller 304, driving gear 303, driving motor 302 and intermediate transfer belt 301 are all rotating bodies, the causes of color misalignment and color unevenness arise periodically. For example, since the time it takes for the intermediate transfer belt 301 to make one revolution is longer than that required for the driving roller 304 to make one revolution, fluctuation ascribable to the former becomes a low-frequency component and fluctuation ascribable to the latter becomes a high-frequency component. Furthermore, fluctuation ascribable to the driving gear 303 becomes a still higher frequency component, and fluctuation ascribable to the driving motor 302 becomes the highest frequency component. Accordingly, in order to extract fluctuation components cause by cause, it will suffice to use a plurality of filters having pass bands that differ from one another. If digital filters are employed, each fluctuation component can be extracted by applying an ideal filter coefficient for every cause.

The fluctuation component of the driving roller 304 ascribed to eccentricity of the driving gear 303 can be extracted by the CPU 401 by filtering the data from the rotary encoder 313 using a digital filter. The digital filter can be implemented by processing in the CPU 401. The fluctuation component extracted during one revolution of the driving roller 304 is tabulated by the CPU 401 as a profile 501 of the driving-gear eccentricity component and is then stored in the RAM 403. The CPU 401 generates a correction profile 502, which is for correcting for the driving-gear eccentricity component, from the driving gear eccentricity component profile 501.

Similarly, with regard to a fluctuation component (a thickness unevenness component or belt surface-speed unevenness component) ascribed to uneven thickness of the intermediate transfer belt 301, the CPU 401 extracts the component by subjecting the data from the image reading sensor 316 to filter processing. The CPU 401 collects the extracted thickness unevenness components over one revolution of the intermediate transfer belt 301, thereby generating a thickness unevenness component profile 503, and stores the profile 503 in the RAM 403. The CPU 401 generates a thickness unevenness component correction profile 504, which is for reducing thickness unevenness components, from the thickness unevenness component profile 503.

Finally, the CPU 401 multiplies the driving gear eccentricity component correction profile 502 by the thickness unevenness component correction profile 504 and calculates the driving frequency of the driving motor 302 from the data representing the product of the two profiles. When the CPU 401 sets this driving frequency in the clock generator 411, the latter generates the driving clock and the motor driver 407 drives the driving motor 302 by the driving clock. As a result, the fluctuation component of each and every cause can be diminished separately and in appropriate fashion.

Rotational speed V_Roller of the driving roller 304 can be expressed as follows based upon diameter r_Roller of the driving roller 304 and angular speed ω_Roller of the driving roller 304:

$$V_Roller = r_Roller \times \omega_Roller \quad (1)$$

Here the angular speed ω_Roller of the driving roller 304 is equivalent to rotational speed V_Gear of the driving gear and therefore can be expressed as follows:

$$\omega_Roller = V_Gear = r_Gear \times \omega_MotorShaft \quad (2)$$

where r_Gear represents the diameter of the hard disk 403 and ω_MotorShaft the angular speed of the driving motor shaft. In Equation (2), the angular speed ω_MotorShaft of the shaft of driving motor 302 is as follows:

$$\omega_MtrShaft = r_MtrShaft \times \omega_MotorFreq \quad (3)$$

Here r_MotorShaft is the maximum diameter (which depends upon machining precision of the shaft) of shaft deflection of the shaft of driving motor 302, and ω_MotorFreq represents the driving frequency of the driving motor 302.

Accordingly, Equation (1) can be transformed as follows:

$$V_Roller = r_Roller \times r_Gear \times r_MotorShaft \times \omega_MotorFreq \quad (4)$$

Since the driving frequency of the driving motor 302 is the clock from the motor driver 407, it can be considered to be constant. Accordingly, the speed fluctuation component of the driving roller 304 becomes as follows:

$$\begin{aligned} dV_Roller &= dr_Roller \times (dr_Gear \times dr_MotorShaft) \\ &= dr_Roller \times d\omega_Roller \end{aligned} \quad (5)$$

Equation (5) means that the detection value from the encoder 313 placed on the shaft of the driving roller 304 includes the eccentricity component of the driving gear and the eccentricity component of the motor shaft.

The actual detection value from the encoder 313 includes speed fluctuation factors other than those mentioned above (namely load fluctuation and other vibration factors internally of the apparatus). However, there are many cases where these other factors have frequencies higher than those associated with the factors mentioned above, and there are many cases where the influence upon the image is small.

Accordingly, by passing the detection value of the encoder 313 through a low-pass filter, it is possible to extract the eccentricity component of the driving gear and the shaft eccentricity component (low-frequency component) of the motor shaft that constitute the main causes of image degradation.

It should be noted that if the machining precision of the shaft of driving motor 302 is sufficiently high and has little influence on the image, it is considered that dr_Gear>>dr_Motorshaft holds. Accordingly, since we can essentially express this as dω_Roller=dr_Gear, this embodiment focuses upon the eccentricity component of the driving gear. It goes without saying that the present invention may be so adapted as to also extract the shaft eccentricity component of the motor shaft, create the correction profile and remove this eccentricity component.

Figure 6:
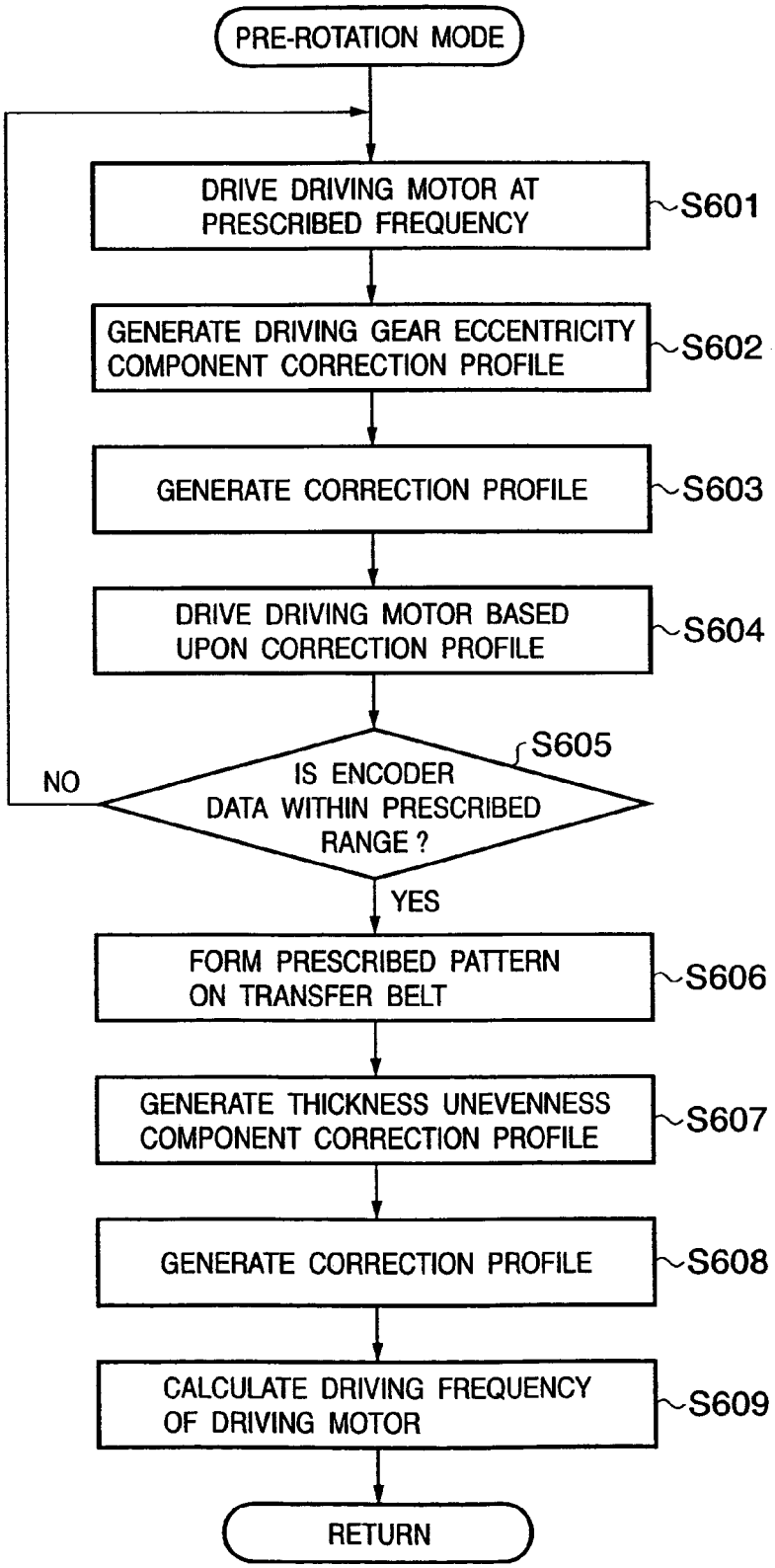
FIG. 6 is an illustrative flowchart of a control method according to this embodiment.

FIG. 6 is an illustrative flowchart of a control method according to this embodiment.

At step S601, the CPU 401 starts driving the driving roller 104 at a prescribed driving frequency Vt set in advance.

At step S602, the CPU 401 extracts the gear eccentricity component, from among multiple amounts of fluctuation in speed, from encoder data transmitted from the ASIC 404.

Figure 7:
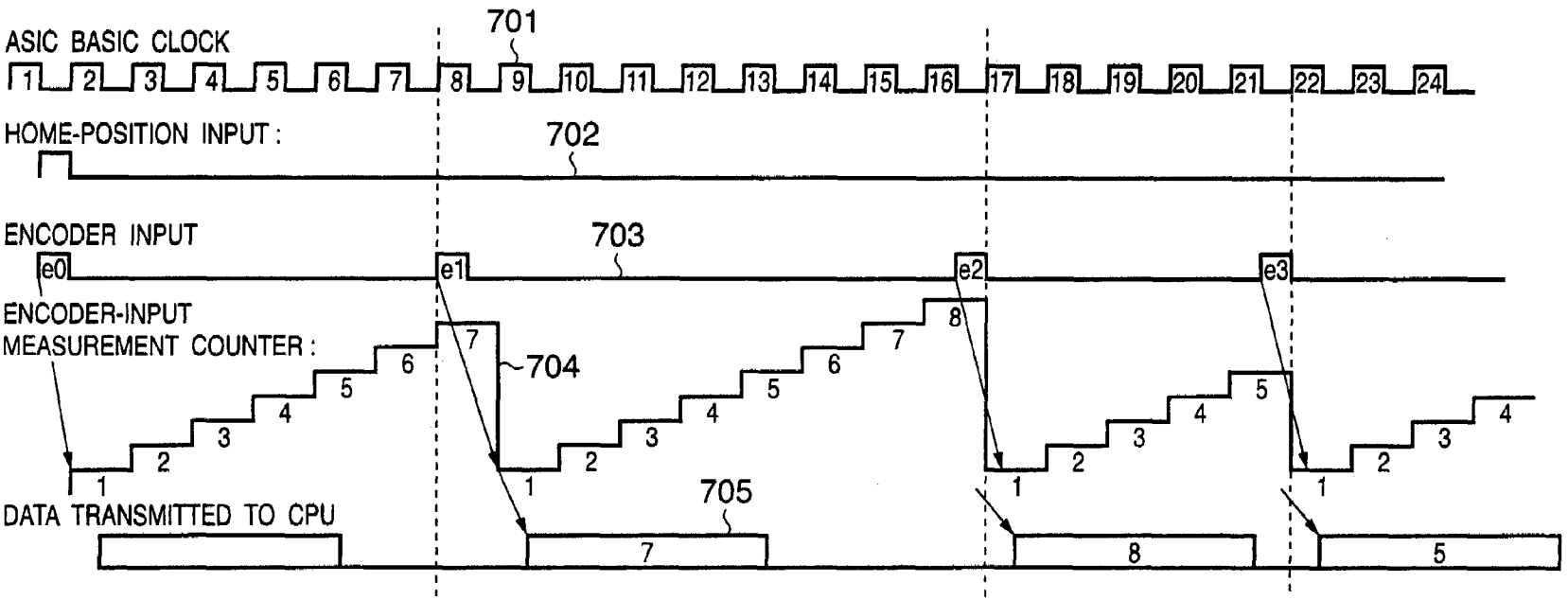
FIG. 7 is a timing chart relating to acquisition of encoder data according to this embodiment.

FIG. 7 is a timing chart relating to acquisition of encoder data according to this embodiment. Reference numeral 701 denotes the timing of the basic clock of ASIC 404; 702 the output data from the sensor 314, which is provided on the shaft of the driving roller 304, for sensing the home position; 703 the output data from the encoder 313; and 704 the value in a counter implemented by the ASIC 404. Based upon output data 703 from the encoder 313, the counter measures the time it takes for the driving roller 304 to make one revolution. That is, the counter contributes to calculation of the rotational speed V_Roller or angular speed $\omega_{13}$ Roller of the driving roller 304. Reference numeral 705 denotes the value measured by the counter and output from the ASIC 404 to the CPU 401.

In accordance with FIG. 7, the time from an encoder input e0 to the next encoder input e1 is measured as being "7" by the counter. Similarly, as will be understood from FIG. 7, a counter value "8" is obtained with regard to the next encoder input e2, and a counter value "5" is obtained with regard to the next encoder input e3.

Rotational speeds V_Roller[i] of the driving roller 304 received from the ASIC 404 are stored in order in the RAM 403 by CPU 401, where i represents a natural number and represents the rotational phase of the driving roller 304. The rotational phase is acquired by the driving-roller home-position sensor 314. The CPU 401 may store the result of applying low-pass digital filtering processing at any time to V_Roller[i], which is the output data from the encoder 313, in the RAM 403. This is for the purpose of removing high-frequency components, which do not constitute a cause of image degradation.

The CPU 401 further calculates the fluctuation amount dV_Roller[i] between V_Roller[i] and a target speed V_target and stores the fluctuation amount in the RAM 403 as the above-mentioned driving gear eccentricity component profile 501. The fluctuation amount dV_Roller[i] is the gear eccentricity component from among the plurality of speed fluctuation amounts, as set forth above. It goes without saying that the number of gear eccentricity components contained in the driving gear eccentricity component profile 501 is equal to the number of samplings of encoder data. Further, it will suffice if the sampling frequency regarding the encoder data is sufficiently high with respect to the frequency of the eccentricity component of the driving gear of driving roller 304.

At step S603, the CPU 401 generates the driving gear eccentricity component correction profile 502, which is for correcting for the eccentricity component of the driving gear, from the driving gear eccentricity component profile 501, and stores the correction profile 502 in the RAM 403. Correction data for one revolution of the driving roller 304 is stored in the driving gear eccentricity component correction profile 502.

A specific method of generating the driving gear eccentricity component correction profile 502 will be described. The amount of correction regarding an ith rotational phase can be found from the following equation:

$$Vc[i]=\{1-(dv_\mathrm{Roller}[i]/V_\mathrm{target})\times \mathrm{Gain}\}\times V_\mathrm{target} \quad (6)$$

where Gain represents a correction reflecting coefficient and is used to decide to what extent the detected amount of fluctuation should be reflected in the correction. For example, if Gain=1 holds, then, theoretically speaking, the amount of fluctuation is corrected for completely. In an actual driving system, however, Gain is set by trial and error to a value among values that are less than one. This is to assure the stability of the correction control system.

At step S604, the CPU 401 uses the driving gear eccentricity component correction profile 502 and drives the driving motor 302 compensatively in sync with the encoder data input. More specifically, the CPU 401 calculates the driving frequency of the driving motor 302 from the correction data that is contained in the driving gear eccentricity component correction profile 502. The CPU 401 sets the calculated driving frequency in the clock generator 411, whereby the motor driver 407 drives the driving motor 302 compensatively.

At step S605, the CPU 401 determines whether each item of data detected by the encoder 313 in the state in which the driving motor 302 has been driven compensatively falls within a target range set in advance. This determination is executed in order to investigate whether the driving roller 304 is being corrected accurately.

The target range is decided in accordance with a target value of image quality of the image forming apparatus to which the present invention is applied. For example, if a relatively high image quality is adopted as the target, then a target range that is relatively narrow is set. Conversely, if a relatively low image quality is adopted as the target, then a target range that is relatively wide is set.

If data that has been detected is outside the target range set in advance, then control returns to step S601 and the driving gear eccentricity component correction profile 502 is generated again. On the other hand, if data that has been detected is within the target range set in advance, then the control proceeds to step S606 because it is considered that the angular speeds of the rotating bodies such as the driving gear 303 and driving roller 304 have stabilized.

At step S606, the CPU 401 reads the image data of the prescribed pattern out of the ROM 402 and controls the image forming units 300 to thereby form the prescribed pattern on the intermediate transfer belt 301.

Figure 8:
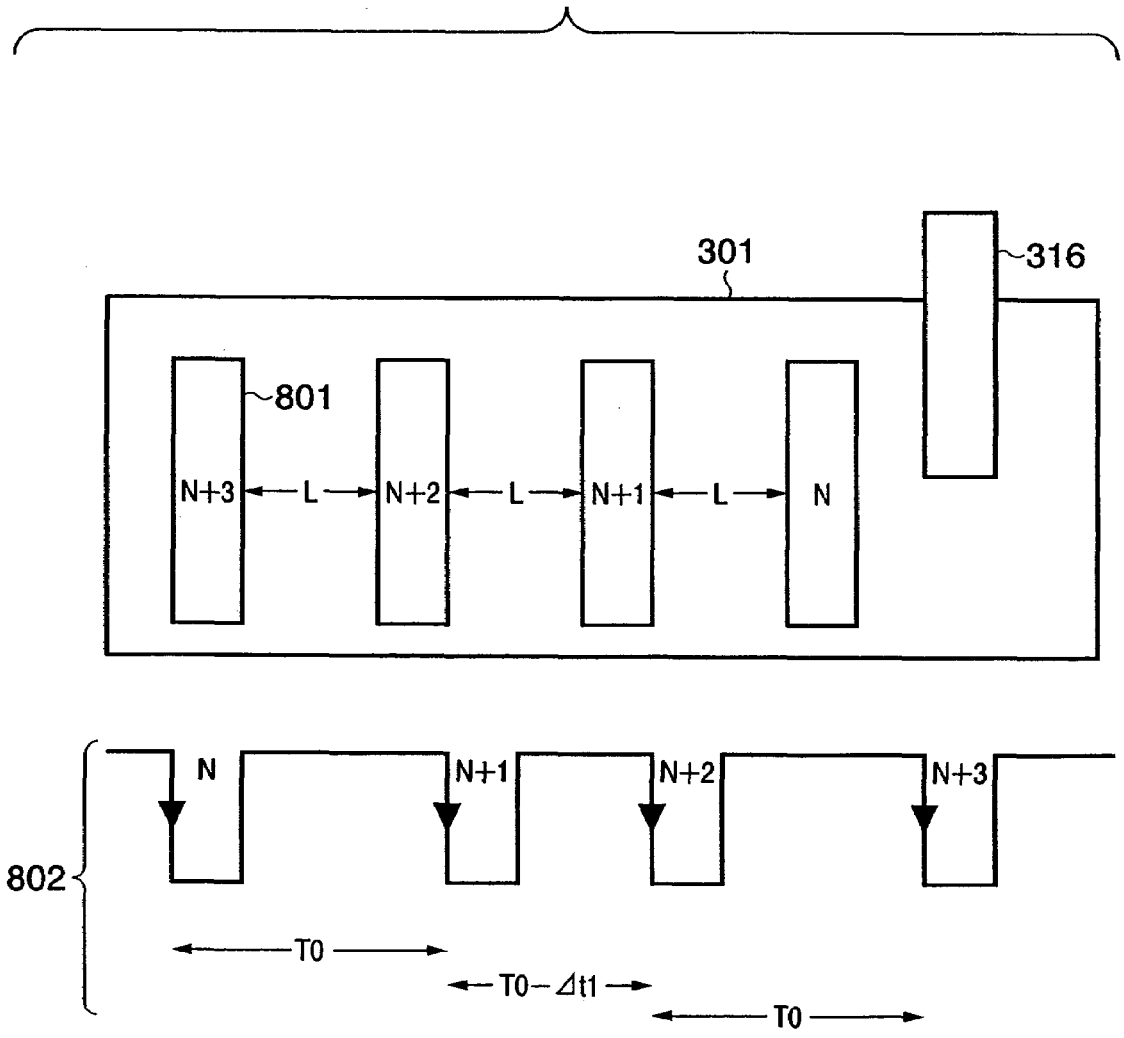
FIG. 8 is a diagram illustrating an example of a pattern according to this embodiment.

FIG. 8 is a diagram illustrating an example of a pattern according to this embodiment. In accordance with this embodiment, the toner image that has been formed on the photosensitive body 305 is transferred to the intermediate transfer belt 301, whereby the pattern is formed. A plurality of patterns 801 are formed in slit-like form at equal intervals of distance L.

Reference numeral 802 denotes an example of the detection waveform of the patterns in this embodiment. The detection waveform is the result of detection by the image reading sensor 316 disposed above the intermediate transfer belt 301. As illustrated in FIG. 8, the input period of the pattern detection signal fluctuates with respect to a target input-interval time T0 if speed at the surface of the intermediate transfer belt 301 is fluctuating.

At step S607, the CPU 401 creates the thickness unevenness component profile 503 and stores it in the RAM 403. The thickness unevenness component is extracted over one revolution of the intermediate transfer belt 301. For example, the CPU 401 applies low-pass digital filtering processing to the data of the input interval acquired by the image reading sensor 316 and extracts the thickness unevenness component. It should be noted that the input interval is acquired as the timer count value of the ASIC 404.

A description will be rendered using the example of FIG. 8. The thickness unevenness component dV is calculated from the following equation:

$$L/(T0\pm dT)=Vt\pm dV \quad (7)$$

where Vt represents the target surface speed of the intermediate transfer belt 301, T0 the target input interval, dT the time fluctuation component of the input interval and L the target interval of the prescribed pattern 801.

Equation (7) is generalized further. For example, if we let T[j] represent the detection time interval between a jth pattern and a (j+1)th pattern, let V[j] represent the traveling speed of the intermediate transfer belt 301 prevailing at this time, let L represent the distance between the two patterns and let Vt (which corresponds to L/T0 mentioned above) represent the target traveling speed of the intermediate transfer belt 301, then a jth thickness unevenness fluctuation component dV[j] is calculated from the following equation:

$$dV[j]=V[j]-Vt=Vt-L/T[j] \quad (8)$$

The CPU 401 calculates dV[j] with regard to one revolution of the intermediate transfer belt 301 and creates the thickness unevenness component profile 503, where j represents the rotational phase of the intermediate transfer belt 301. The number of samples of data contained in the thickness unevenness component profile 503 is equal to the number of patterns formed on the intermediate transfer belt 301. Further, the sampling frequency is sufficiently high with respect to the frequency of the thickness unevenness component of the intermediate transfer belt 301.

It should be noted that T[j] and V[j] actually detected include speed fluctuation components the frequency of which is higher than that of the frequency fluctuation ascribable to the period of thickness unevenness of the belt. This means that it will suffice to apply low-pass digital filtering processing to the detected T[J] or V[j] and then plant the result in the thickness unevenness component profile 503. As a result, high-frequency components that do not readily become a cause of image degradation can be eliminated.

At step S608, the CPU 401 generates the thickness unevenness component correction profile 504, which is for correcting for thickness unevenness, based upon the thickness unevenness component profile 503, and stores this profile in the RAM 403.

For example, the CPU 401 applies the following equation to dV[j], which has been planted in the thickness unevenness component profile 503, thereby calculating correction data Vca[j] regarding a jth rotational phase:

$$Vca[j]=(Vt-dV[j]\times G)/Vt \quad (9)$$

where G represents a correction reflecting coefficient that is similar to Gain mentioned above. The correction data Vca[j] thus calculated is planted in the thickness unevenness component correction profile 504 by the CPU 401.

At step S609, the CPU 401 calculates the driving frequency of the driving motor 302 based upon the driving gear eccentricity component correction profile 502 and thickness unevenness component correction profile 504 and drives the driving motor 302 compensatively using the driving frequency calculated.

For example, as shown in FIG. 5, the CPU 401 multiplies each item of correction data contained in the driving gear eccentricity component correction profile 502 by each item of correction data contained in the thickness unevenness component correction profile 504 and calculates a driving frequency Va[i,j].

$$Va[i,j]=Vc[i]\times Vca[j] \quad (10)$$

where Va[i,j] represents the driving frequency that prevails when the rotational phase of the driving roller 304 is i and the rotational phase of the intermediate transfer belt 301 is j. It should be noted that if a driving frequency profile containing the driving frequency Va[i,j] is stored in the RAM 403, the amount of processing executed by the CPU 401 can be reduced.

By detecting the home position of the driving roller 304 using the driving-roller home-position sensor 314, the CPU 401 acquires the present rotational phase i. On the other hand, by detecting the home-position mark on the intermediate transfer belt 301 using the belt home-position sensor 315, the CPU 401 the present rotational phase j. The CPU 401 acquires the driving frequency synchronized to these phases and transmits the acquired driving frequency to the ASIC 404. The driving frequency may be calculated when suitable from the driving gear eccentricity component correction profile 502 and thickness unevenness component correction profile 504, or may be acquired by reading out what has been calculated beforehand and planted in the driving frequency profile.

The present invention may employ methods other than a method of extracting the speed of the intermediate transfer belt 301 described in the embodiment. For example, the present invention may employ a method of measuring unevenness in the thickness of the intermediate transfer belt 301 in advance by a measuring device and calculating the above-described correction profiles from the measured thickness unevenness. Alternatively, the present invention may employ a method of providing the transfer belt itself with a plurality of optical or magnetic periodic marks and extracting the travelling speed of the transfer belt by detecting the marks.

By performing the above-described control for correction of rotational speed continuously at all times, inconsistencies in density and color misalignment can be reduced over the prior art and an improvement in image quality can be expected. Of course, it may be so arranged that the image forming apparatus creates the correction profiles immediately after power is introduced or when creation is designated by the user, etc.

Further, in the embodiment described above, the invention has been described with regard to the eccentricity component of a driving gear and the thickness unevenness component of a transfer belt. However, it goes without saying that the present invention may extract fluctuation amounts individually with regard to third, fourth or more rotating bodies or causes of fluctuation and correct for each fluctuation amount appropriately The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-309871 filed on Oct. 25, 2004, which is hereby incorporated by reference herein.

What is claimed is:

1. An image forming apparatus for forming a color image, comprising:

a plurality of rotating bodies for forming a color image by rotating in cooperation;

a detection unit for detecting, with regard to first and second rotating bodies among said plurality of rotating bodies, amounts of fluctuation in rotational speeds of said rotating bodies that cause a decline in image quality of the color-image formed;

a rotational speed correction unit for correcting the rotational speed of said first rotating body so as to cancel out the amount of fluctuation detected with regard to said first rotating body; and a control unit for controlling the rotational speed of said second rotating body so as to cancel out the amount of fluctuation in rotational speed of the second rotating body detected after the rotational speed of said first rotating body has been corrected.

2. The apparatus according to claim 1, wherein said plurality of rotating bodies include:

a transfer belt for transferring images of developing materials, which have formed by a plurality of developing materials of colors that differ from one another, to a printing material;

a driving roller for driving said transfer belt;

a driving gear for driving said driving roller; and a driving motor for driving said driving gear.

3. The apparatus according to claim 2, wherein said detection unit includes:

a first fluctuation amount detecting unit for detecting the amount of fluctuation of said driving roller, which is caused by eccentricity of said driving gear; and a second fluctuation amount detecting unit for detecting the amount of fluctuation of said transfer belt, which is caused by an unevenness in speed of the belt surface of said transfer belt.

4. The apparatus according to claim 3, wherein said rotational speed correction unit includes a first creating unit for creating a first correction profile, which is for correcting the rotational speed of said driving motor, from a plurality of amounts of fluctuation detected by said first fluctuation amount detecting unit while said driving roller makes one revolution; and said rotational speed control unit includes:

a second creating unit for creating a second correction profile, which is for correcting the rotational speed of said driving motor, from the amount of fluctuation acquired by said second fluctuation amount detecting unit while said transfer belt makes one revolution owing to driving of said driving motor according to the first correction profile;

a calculating unit for calculating driving frequency of said driving motor from the second correction profile; and a driving control unit for driving said driving motor using the driving frequency calculated.

5. The apparatus according to claim 4, further comprising an execution control unit for exercising control in such a manner that processing for calculating the driving frequency will be executed before formation of the color image on the printing material.

6. A color image forming apparatus for forming a color image, comprising:

a belt transport device that includes a transfer belt for transferring an image, which is produced by a developing material, to a printing material, a rotating body for frictionally driving said transfer belt, and a driving unit for driving said rotating body;

a first phase detecting unit for detecting the rotational phase of said rotating body;

a first fluctuation amount detecting unit for detecting amount of fluctuation in rotational speed of said rotating body at the detected rotational phase;

a first correction data generating unit for generating first correction data at the detected rotational phase based upon the detected rotational phase and the detected amount of fluctuation in the rotational speed of said rotating body;

a second phase detecting unit for detecting the rotational phase of said transfer belt;

a second fluctuation amount detecting unit for detecting amount of fluctuation in traveling speed of said transfer belt at the detected rotational phase of said transfer belt;

a second correction data generating unit for generating second correction data at the detected rotational phase of said transfer belt based upon the detected rotational phase of said transfer belt and the detected amount of fluctuation in the travelling speed of said transfer belt;

a calculating unit for calculating driving frequency of said driving unit that corresponds to a combination of the rotational phase of said rotating body and the rotational phase of said transfer belt, based upon the first correction data corresponding to the detected rotational phase of said rotating body and the second correction data corresponding to the detected rotational phase of said transfer belt; and a control unit for controlling driving of said driving unit in accordance with the calculated driving frequency.

7. A method of controlling an image forming apparatus that includes a plurality of rotating bodies for forming a color image by rotating in cooperation, said method comprising the steps of:

detecting, with regard to first and second rotating bodies among said plurality of rotating bodies, amounts of fluctuation in rotational speeds of said rotating bodies that cause a decline in image quality of the color image formed;

correcting the rotational speed of said first rotating body so as to cancel out the amount of fluctuation detected with regard to said first rotating body; and controlling the rotational speed of said second rotating body so as to cancel out the amount of fluctuation in rotational speed of the second rotating body detected after the rotational speed of said first rotating body has been corrected.

8. A method of controlling a color image forming apparatus that includes a transfer belt for transferring an image, which is produced by a developing material, to a printing material, a rotating body for frictionally driving said transfer belt, and a driving unit for driving said rotating body, said method comprising the steps of:

detecting the rotational phase of said rotating body;

detecting amount of fluctuation in rotational speed of said rotating body at the detected rotational phase of said rotating body;

generating first correction data at the detected rotational phase based upon the detected rotational phase of said rotating body and the detected amount of fluctuation in the rotational speed of said rotating body;

detecting the rotational phase of said transfer belt;

detecting amount of fluctuation in traveling speed of said transfer belt at the detected rotational phase of said transfer belt;

generating second correction data at the detected rotational phase of said transfer belt based upon the detected rotational phase of said transfer belt and the detected amount of fluctuation in the travelling speed of said transfer belt;

calculating driving frequency of said driving unit that corresponds to a combination of the rotational phase of said rotating body and the rotational phase of said transfer belt, based upon the first correction data corresponding to the detected rotational phase of said rotating body and the second correction data corresponding to the detected rotational phase of said transfer belt; and controlling driving of said driving unit in accordance with the calculated driving frequency.

* * * * *

UNITED STATES PATENT AND TRADEMARK OFFICE

CERTIFICATE OF CORRECTION

PATENT NO. : 7,099,614 B2
APPLICATION NO. : 11/251772
DATED : August 29, 2006
INVENTOR(S) : Kazuhisa Koizumi It is certified that error appears in the above-identified patent and that said Letters Patent is hereby corrected as shown below:

COLUMN 1:
Line 52, “cause (4),” should read --curve (3),--.
Line 56, “roll.” should read --roller.--.

COLUMN 4:
Line 10, “rotate” should read --rotates--.
Line 31, “diminished.” should read --is diminished.--.

COLUMN 5:
Line 7, “that” should read --that are--.

COLUMN 6:
Line 6, “uneven” should read --unevenness--.
Line 10, “are” should read --is--.

COLUMN 12:
Line 3, “CPU 401” should read --CPU 401 acquires--.

COLUMN 13:
Line 11, “include:” should read --includes:--.

Signed and Sealed this

Twentieth Day of March, 2007

JON W. DUDAS
*Director of the United States Patent and Trademark Office*